US005275241A

United States Patent [19]

Vigor et al.

[11] Patent Number: 5,275,241

[45] Date of Patent: Jan. 4, 1994

[54] CIRCULATING VALVE APPARATUS AND DRILL STEM TEST METHOD ALLOWING SELECTIVE FLUID COMMUNICATION BETWEEN AN ABOVE PACKER ANNULUS AND A RATHOLE

[75] Inventors: Andrew W. Vigor; Adrian J. Stewart, both of Aberdeen, Scotland; Dinesh R. Patel, Sugar Land, Tex.

[73] Assignee: Schlumberger Technology Corporation, Houston, Tex.

[21] Appl. No.: 984,024

[22] Filed: Dec. 1, 1992

[30] Foreign Application Priority Data

Dec. 2, 1991 [GB] United Kingdom ..... 9125612

[51] Int. Cl.[5] ..... E21B 34/00

[52] U.S. Cl. ..... 166/373

[58] Field of Search ..... 166/373-375; 166/381, 382, 386, 387, 316, 319, 320; 166/321; 166/332, 334

[56] References Cited

U.S. PATENT DOCUMENTS 4,669,537 6/1987 Rumbaugh ..... 166/373 X 4,979,569 12/1990 Anyan et al. .

FOREIGN PATENT DOCUMENTS 0265054 4/1988 European Pat. Off. .

WO90/088-78A1 8/1990 PCT Int'l Appl. .

*Primary Examiner*—Thuy M. Bui

*Attorney, Agent, or Firm*—Henry N. Garrana; John H. Bouchard

[57] ABSTRACT

A test string section for a well comprises a circulating valve (40) including a mandrel (60), a rupture disk (68), and a series of ports (56). The valve is arranged above a packer. A second port (50) is arranged on a pipe section (44) below the packer and a flow tube (52) extends through the internal bore (66). On rupturing the rupture disk, the port (56) is opened whereby mud can be pumped into a rathole via the port to kill the rathole while the seal of the packer against a wall of the wellbore is still intact and the packer remains in a set condition.

20 Claims, 4 Drawing Sheets

CIRCULATING VALVE APPARATUS AND DRILL STEM TEST METHOD ALLOWING SELECTIVE FLUID COMMUNICATION BETWEEN AN ABOVE PACKER ANNULUS AND A RATHOLE

BACKGROUND OF THE INVENTION

The subject matter of the present invention relates to drill stem testing methods and apparatus, and, in particular, to apparatus and techniques for killing wells after testing. The invention is particularly suitable for pressure controlled testing systems but is not limited to such systems. The invention also relates to production well testing techniques, and to the testing of open hole sections.

Drill stem testing systems are well known and reference should be made by way of example to the applicant's prior publications European Patent EP-A-63519, U.S. Pat. No. 4,718,494 and U.S. Pat. No. 4,915,168, the contents of which are incorporated into this specification by reference. These three publications describe the principles of drill stem testing as well as the principles of the major drill stem test string components and their operation.

A drill stem test tool string suspends from a pipe string in a wellbore, and a packer is set thereby isolating a rathole from an annulus. The term "rathole" is defined to be the annular space which exists between the pipe string and a wall of the wellbore below the set packer in the wellbore. The term "annulus" is defined to be the annular space which exists between the pipe string and the wall of the wellbore above the set packer in the wellbore. Formation fluids (fluid received from an earth formation during testing) accumulate both in the rathole and in the pipe string. For safety reasons, it is necessary to remove these formation fluids from the rathole and pipe string in order to kill the well. Fluids are removed from the pipe string by reverse circulation of mud through one or more reversing tools which form a part of the tool string. A typical reversing tool is described in EP-A-63519 referred to previously. Initially, the tester valve above the set packer is closed, separating the rathole from the cushion. Conditioned mud is then pumped down an annulus area between the test string and the well casing, i.e. through the reversing tool and into the test string thereby forcing formation fluids out through the top of the string. Reverse circulation continues until all formation fluids have been removed. Since the mud is not necessarily homogenous, some filtration is probable and it is common practice to pump at least 1.5 times the tubing volume during reverse circulation to ensure complete removal of formation fluids.

In order to restore the mud in the annulus and the tubing to their original conditions, mud is then circulated down the drill pipe tubing through the reversing valve and up the annulus. Finally, the rathole must be equalized. Under usual drilling conditions, the formation zone is relatively small and equalization is achieved by forcing formation fluids back into the surrounding formation. To do this, the seals between the packer and the well casing are released and mud is pumped from the annulus into the rathole between the packer and the casing. As the hydrostatic pressure of the annulus is much greater than the formation pressure in the rathole, this operation is safe and ensures removal of formation fluids.

U.S. Pat. No. 4,718 494 referred to previously describes a type of tool which is controlled by annulus pressure. This tool is one of a class of tools which together make up a drill stem test (DST) string. This tool reduces the need for string movement and is particularly suited to use on offshore floating rigs. Some of the tools are operated by overpressurization of the annulus, for example, to burst a rupture disk in a valve.

A variant of the DST string is the tapered test string. This string is suitable where very narrow bores must be drilled, for example, to overcome geological difficulties preventing the usual 7" or 9⅝" casings from being used. In such areas, a casing is sunk which has an external diameter of 5 inches or smaller. However, the external diameter of standard DST tools is 5.0 inch and they cannot therefore be used in these small bore casings. As the internal diameter of 7 inch casing is 5.89 inches, the clearance is small even under usual conditions.

To overcome this problem small bore DST tools have been developed which have an external diameter of 3⅜ inch and an internal diameter of ½ inch. However, the size restrictions on these tools are such that they are not as satisfactory as the 5 inch standard tool. It is therefore sometimes preferred to operate a tapered test string which comprises a string of standard 5.00 inch tools above a fixed packer higher up the hole in the larger diameter 7 inch casing and a string of narrow gauge tubing in the rathole.

Although it is possible to set a packer in a 5 inch casing or smaller, it is preferable to locate the packer in the wider bore section of the well. This means that the rathole beneath the packer is the complete length of the narrow bore section. The production packer has a smooth inner surface which allows an assembly to locate and seal inside it.

In some cases, the 5 inch casing may be up to 2000 ft. in length. Under these circumstances, the technique described previously for killing the rathole is no longer practical as there may no longer be a sufficient pressure difference across the packer to ensure that the hydrostatic pressure in the annulus will retain the formation fluids in position on release of the packer seal. The consequences of releasing the packer seal under these conditions could be catastrophic, resulting in a blow out. A further problem arises in that the formation around the rathole can act as a one way valve, resisting attempts to force large amounts of formation fluids back into the formation rock.

In view of these problems, it is not safe or desirable to release the packer seal to pump in annulus mud, the technique which is usually used in the short rathole example given above. Attempts have been made to overcome the problem using a hold open (HOOP) in a pressure controlled tester (PCT) downhole tester valve. This allows annulus pressure to be bled while keeping the valve fully open. To reclose the PCT, all that is required is the repressurization of the annulus and further bleeding. The normal open/close sequence can be continued until the hold open cycle is reached again. As a result, the industry has identified a need for a reliable, safe method and apparatus for removing formation fluids from a long small diameter casing.

SUMMARY OF THE INVENTION

Accordingly, it is a primary object of the present invention to overcome the problems mentioned above and to meet the need for a reliable, safe method and apparatus for removing formation fluids from a long small diameter casing.

It is a further object of the present invention to provide a novel method and apparatus which allows communication between the annulus above the packer and the rathole annulus below the packer with the tubing seal assembly still engaged in the packer.

In accordance with these and other objects of the present invention, a novel method and apparatus allows communication between the annulus and the rathole with the tubing seal assembly still engaged in the packer. With such an arrangement, mud may be pumped into the rathole and formation fluids may be removed through the test string. More specifically the invention provides a pipe string adapted to be disposed in a wellbore including a packer and means arranged above and below the packer for selectively communicating between the annulus above the packer and the rathole annulus below the packer through the pipe string with the packer sealed against the wellbore casing.

One aspect of the invention provides an apparatus for communicating between a wellbore rathole and a wellbore annulus, comprising a valve having a normally closed first port to be arranged on a pipe string above a packer to communicate between the annulus and the internal bore of the string on opening of the first port, a second port arranged on a pipe section below the packer to communicate between the rathole and the string bore, a flow pipe extending from a position above the first port to a position below the second port and defining a pipe annulus between the external surface of the flow pipe and the string bore, and means for selectively opening the first port to establish communication between the annulus and the rathole via the first and second ports and the pipe annulus.

The invention also provides a method of killing a well rathole after testing, comprising opening a port in a test string above the packer, pumping mud from the well annulus through the test string via the open port and a second port below the packer, and evacuating formation fluids from the rathole through a flow pipe extending through the string bore, wherein the packer remains sealed against the well casing during killing.

The invention in its various aspects has the advantage that a communication may be made between the annulus and the rathole with the packer still sealed against the casing, thus avoiding the safety problems of the prior art.

In one preferred embodiment, a port in a valve above the packer is opened by a rupture disk under annulus overpressurization. This establishes communication between the annulus and the rathole via the valve bore, drill pipe tubing and a further port below the packer whereby mud can be pumped into the rathole. The bore of the valve and pipe tubing also has a small diameter pipe through which formation fluids can be expelled to the surface, avoiding the problems encountered when formation fluids are forced back into the formation rock.

In a further aspect of the invention, a valve is provided which is located above the packer and communicates with a port below the packer and giving access between the pipe tubing internal bore and the rathole. In normal operation, a port in the valve is left open allowing communication between the annulus and the rathole. In this position, cushion fluids can be circulated down to the rathole and the valve closed by bursting a rupture disk. The operation is the reverse of the aforementioned previous aspects of the invention and has the advantage that the cushion can be circulated, whereby a liquid cushion can be used as opposed to a gas cushion which may result in a considerable cost saving, as well as enhancing safety.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
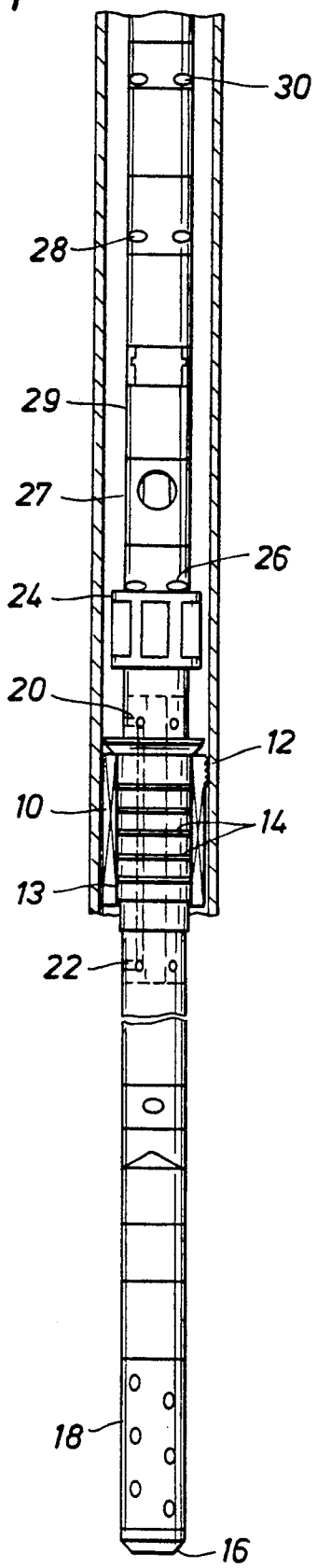
FIG. 1 illustrates a drill stem test (DST) string including a valve embodying the invention.

Referring to the string of FIG. 1, a packer 10 is a permanent packer which is held against a wellbore casing by combination chevron seals and spring teeth 12. The inner surface of the packer 10 is smooth and a seal assembly 13 carries a number of O-ring seals 14 which seal against the inner surface of the packer 10 to separate the annulus above the packer from the rathole below the packer 10. The seal assembly 13 is a length of pipe extending through the packer 10. The packer 10 is arranged in a wide 7 inch casing section and is the first stage of the taper string. The seal assembly 13 is shown more clearly in FIG. 2 where the permanent packer is shown by numeral 110, the seal assembly is shown by seal assembly 113, and the O-rings are shown by O-ring seals 114. In FIG. 1, below the packer 10, there exists a tubing which extends into the rathole. The rathole is defined to be the annulus section below the set packer between the tool string and a wall of the wellbore. An annulus also exists above the set packer. At the bottom of the string is a bull nose 16 which is included to protect the tools further up the string. Above the bull nose 16 are the perforating guns 18. The perforating guns 18 include shaped charges which, upon detonation, perforate the casing (not shown) to allow formation fluids to flow into the rathole. Above the perforating guns 18 are a number of spacers and testing tools, such as temperature and pressure sensors, details of which are well documented in the prior art and not relevant to the present invention. The final tool is a below packer circulating valve (BPCV) 20 arranged to extend through the seal assembly 13, both above and below the packer 10, and communicating with ports 22 below the packer. The valve 20 will be described in further detail in due course.

The tools above the packer are also well known and comprise a gauge carrier 24, a pressure operated reference tool (PORT) 26, a multi cycle circulating valve (MCCV) 28, a pressure controlled tester (PCT) 27, a multi sensor recorder transmitter (MSRT) 29, and a single shot hydrostatic overpressure reverse tool (SHORT) 30. Each tool is separated by a length of pipe and MCCV 28 and SHORT 30 are both controlled by either tubing or annulus pressure via ports 30 on their outer surfaces. In the case of SHORT 30, for example, a pulse of annulus pressure fractures a rupture disk to make a mandrel sealing the port allow reverse circulation of mud from the annulus through the tubing. Further tools which are not shown may also be provided.

Figure 2:
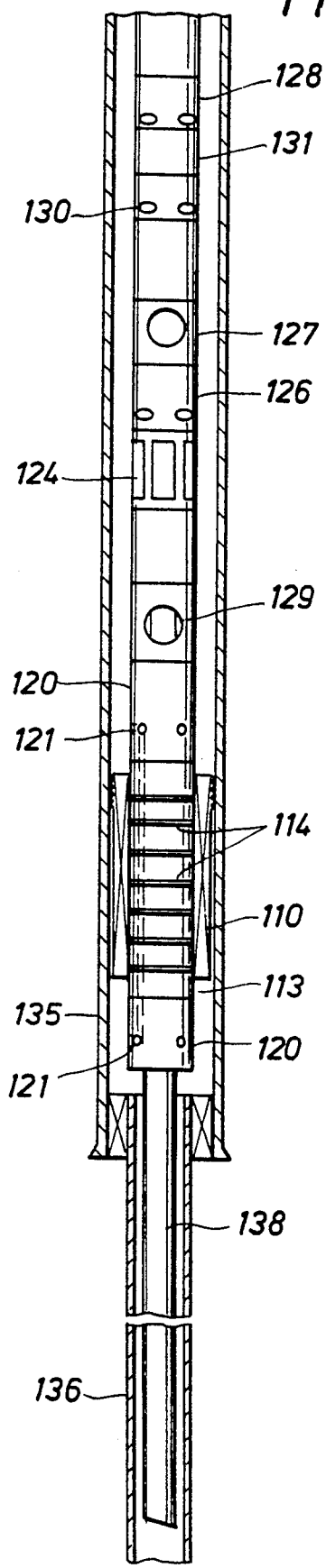
FIG. 2 illustrates a tapered DST string in place in its liner.

The tapered string shown in FIG. 2 is similar above the packer, to the string of FIG. 1. At the upper end of the string, a pair of reverse circulating valves 128, 130 are separated by a length of tubing 131. Below the reverse circulating valve is a PCT 127 and a PORT 126 followed by a gauge carrier 124. A pipe tester valve 129 and a further length of tubing separate the PORT from the below packer circulating valve 120. The below packer circulating valve 120 extends through the seal assembly 113 as described previously. The valve 120 has ports 121 both below and above the seal assembly 113.

All the tools described above are arranged within a 7 inch casing 135. Below the packer 110, the casing diameter changes to a 4½ inch casing 136 or smaller and the tail pipe 138 below the below packer circulating valve is of smaller diameter.

Figure 3:
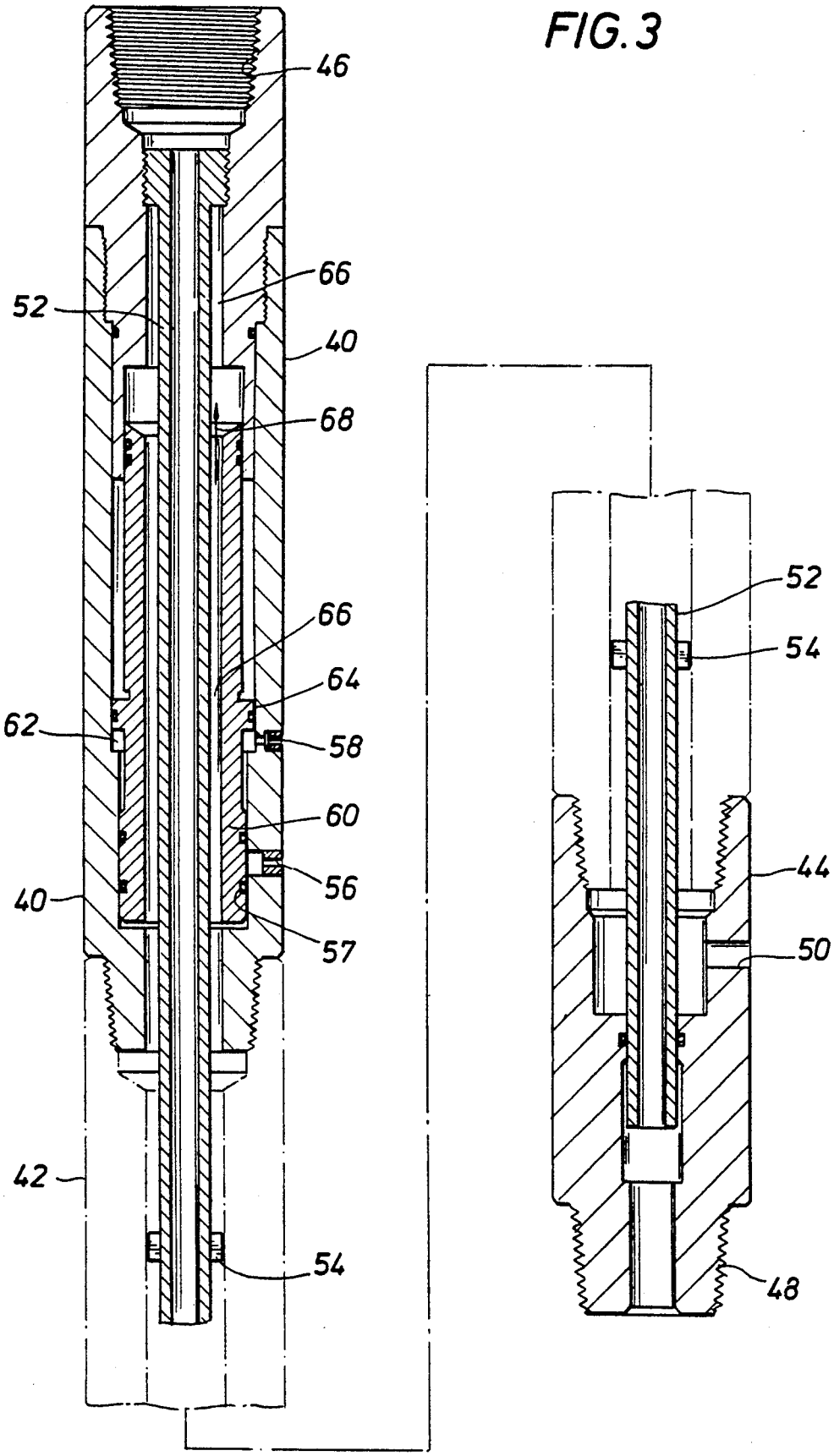
FIG. 3 illustrates a first embodiment of a below packer circulating valve embodying the invention.

Referring now to FIG. 3, the below packer circulating valve (BPCV) 20 of FIG. 1, in accordance with the present invention, is illustrated in greater detail. The circulating valve 20 comprises three sections: an upper section 40 which houses the valve and which is arranged above the production packer; an intermediate section 42 which extends through the packer and which is no more than a length or lengths of pipe tubing; and a lower section 44. The sections 40, 42, 44 are screwed together, the lower end of each section having a tapered male thread which is received in a correspondingly tapered female thread at the upper end of the sections. The upper end of the upper section 40 and the lower end of the lower section 44 have similar threaded portions 46, 48 for connection to the next member of the string. The sections 40, 42, 44 could be construed as a single piece and references to sections should be interpreted as references to portions of a larger assembly or separate removable portions.

The lower section 44 is the lower circulation sub and includes a flow port 50 which extends through the pipe wall communicating the rathole (the annulus section below the set packer) with the internal bore of the pipe. Although only one port is shown, between 4 and 8 ports are arranged around the sub, each port having a diameter of ½ inch.

A one-inch diameter flow tube 52 extends through the 1¾ inch diameter internal bore of the assembly and is centralized by centralizers 54. The upper section 40 of the valve 20 is a modified single shot hydrostatic overpressure reverse tool (SHORT), hereinafter termed SHORT 40. The SHORT 40 has a port 56 and a pressure activated rupture disk 58. The SHORT 40 includes a mandrel 60 which acts as a gate over port 56. In the closed position shown in FIG. 5, the mandrel 60 is located in a position whereby the gate over port 56 is closed, annular seal 57 acting to seal the mouth of port 56. However, on breaking the rupture disk 58 by a burst of annulus overpressure, the pressure vents into chamber 62 behind the rupture disk, acting on piston 64 to force the mandrel 60 upwards. This causes port 56 to open thereby communicating the inner bore 66 of the chamber with the annulus above the set packer. In fact, the valve 20 of FIG. 3 usually includes four ports 56 spaced around the circumference in a similar manner to ports 50 and the mandrel 60 includes four annular seals 57. The seals are typically O-ring seals sealing on the inner wall of the SHORT 40 around the port.

The valve 20 may be used to kill the formation zone in the following manner. In normal operation, formation fluids can flow from the rathole to the surface through the flow tube 52. Once testing is complete, the flow valve located up-stream of the production packer will be closed and the cushion reverse circulated with mud as described previously. Rupture disk 58 will then be blown by a overpressurization of the annulus as a result of which pressure acting on piston 64 will force mandrel 60 to move in the direction of arrow 68 in FIG. 3 opening ports 56 in the valve.

The result of the blown rupture disk 58 is that annulus mud can be pumped into the inner bore 66 of the tool through ports 56 which are located above the packer, through the bore 66, and out into the rathole through ports 50 which are located below the packer. In this way, formation fluid can be reverse circulated out of the rathole via the tail pipe (which, in the FIG. 2 example, is open at its bottom end) and the flow tube 52 even though the production packer 10 is still sealed in position against the wellbore casing. However, in order to remove formation fluids via the flow tube 52, the tester valve up-stream of the packer (valve 129 in FIG. 2) must first be opened.

Figure 4:
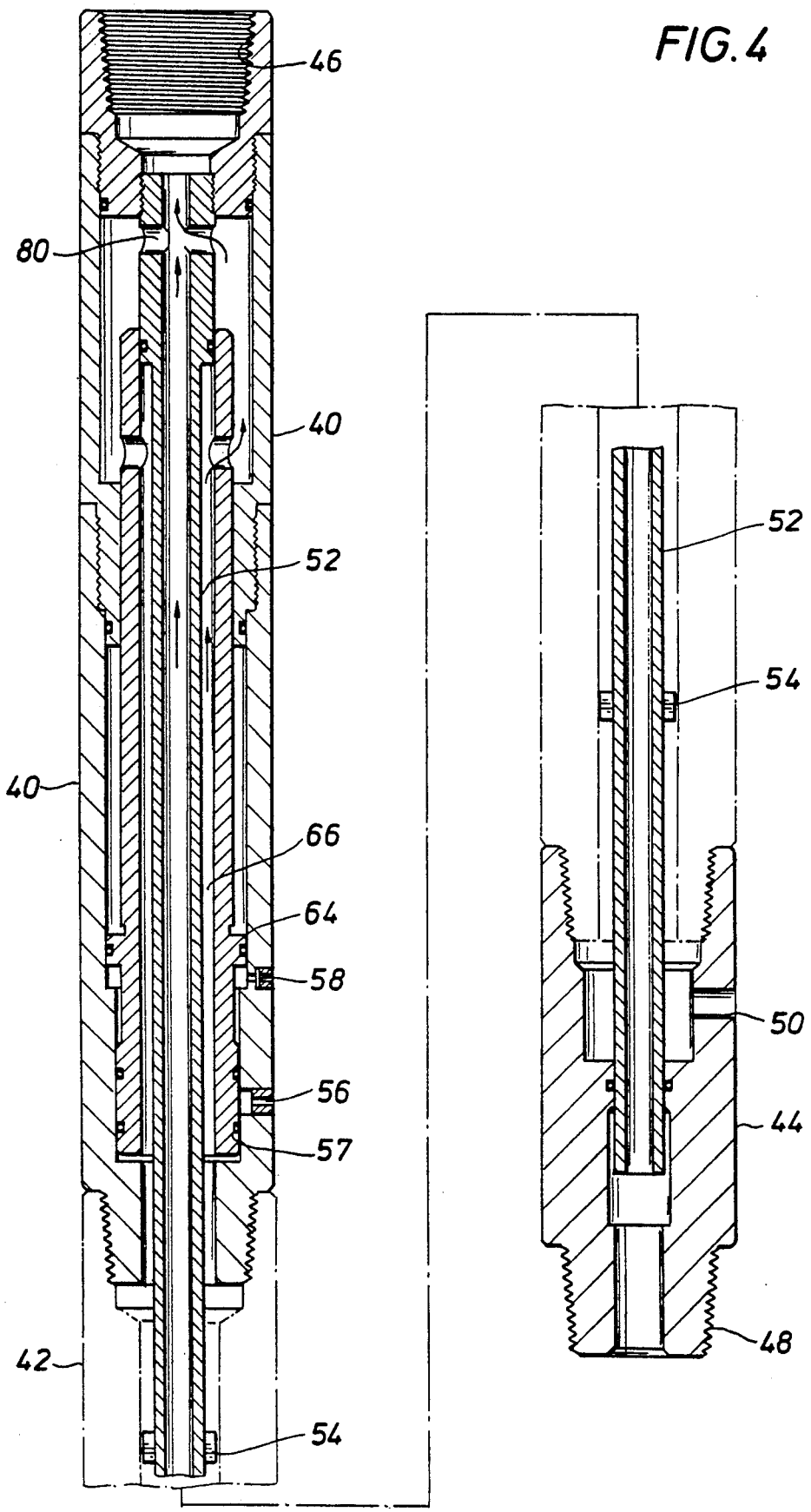
FIG. 4 illustrates an alternative embodiment to the valve illustrated in FIG. 3.

Referring to FIG. 4, an alternative embodiment of the below packer circulating valve 20 of FIG. 1, in accordance with the present invention, is illustrated. In FIG. 4, this embodiment operates in the same manner as that of FIG. 3 to enable mud to be pumped from the annulus to the rathole with the packer 10 set in place. However, the valve 20 has been modified to permit a wider diameter flow under usual operating conditions. The embodiment of FIG. 3 restricts flow during testing by inclusion of the 1 inch diameter flow tube 52, although this tube 52 may be made larger. To overcome this restriction, flow ports 80 are included in the flow tube 52 at the upper end of the valve 20 so that formation fluids can additionally flow in through ports 50, at the bottom of the valve, and through inner bore 66 as well as through flow tube 52.

In the embodiments described, it would be possible to kill the well above and below the packer 10 in a single operation. However, to maximize safety, it is considered likely that the well would first be killed above the tester valve (129 FIG. 2) and then the BPCV 20, 120 opened and the rat hole killed by reverse circulation of mud pumped down the annulus, through the BPCV and back up the internal flowpipe.

Figure 5:
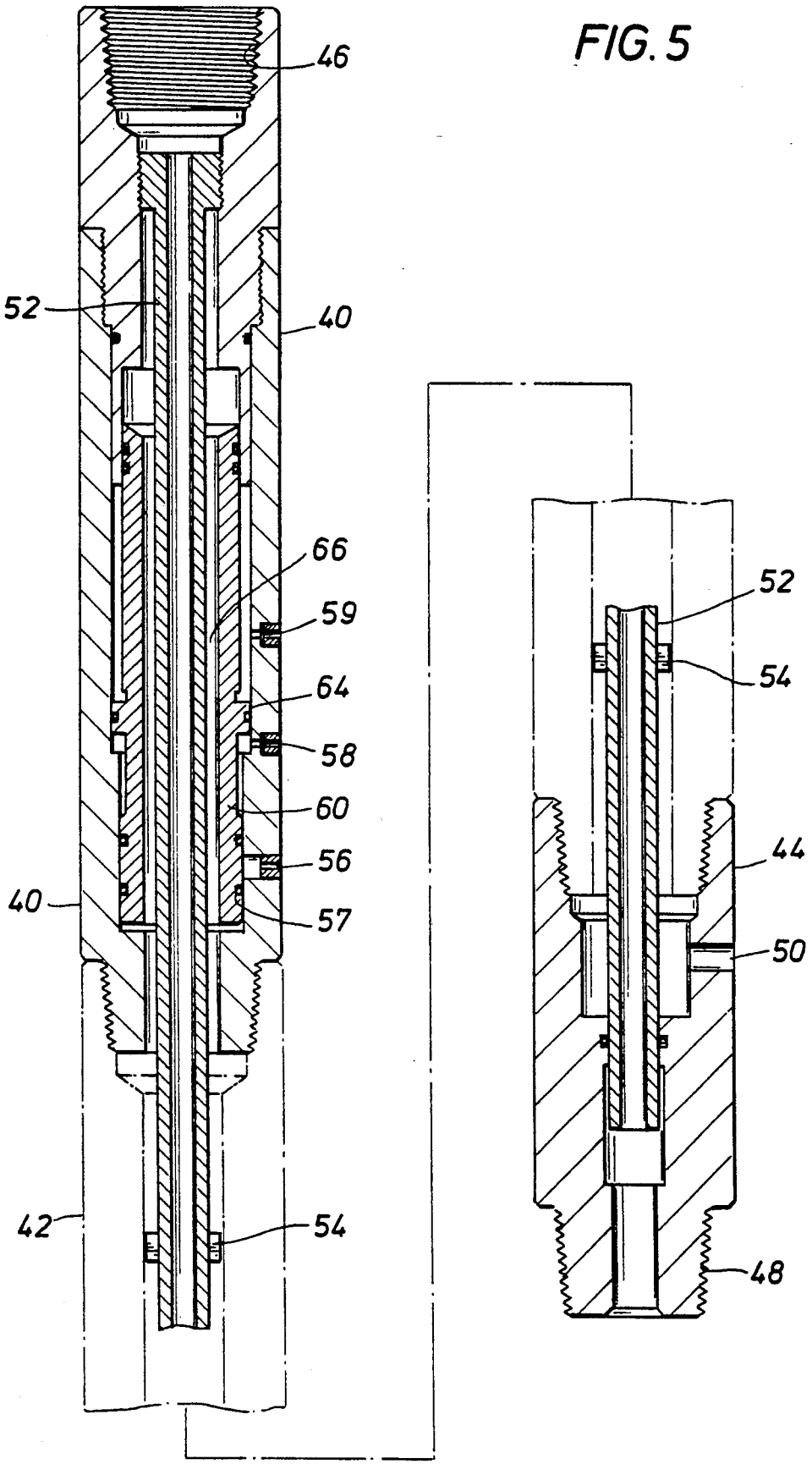
FIG. 5 illustrates a modification to the valve illustrated in FIGS. 3 or 4.

Referring to FIG. 5, a further modification to the below packer circulating valve 20 of FIG. 1 is illustrated. The construction of the tool is identical to that of FIG. 3 except that an additional rupture disk 59 is included. The mandrel 60 is initially disposed in a retracted position so that ports 50 and 56 are open. The tool is run into the wellbore already open. In this position, cushion fluid can be circulated down the tubing to the rathole. Mud can be removed by pumping through an open up-stream valve, into the rathole, and through ports 50 and 56 back to the annulus. By applying annulus pressure, the first rupture disk 59 is blown, the mandrel 60 moves downwardly, and the circulating/reverse circulating ports (including port 56) are closed. At this point a conventional DST can be performed. At the end of the test, a higher annulus pressure will burst the second rupture disk 58 re-opening the ports (including port 56) enabling the well to be killed. The advantage of using a lower cushion is that a liquid cushion rather than a gas cushion may be used, reducing costs greatly. Liquid cushions are much easier to handle as well as being safer.

A fourth embodiment, not shown, combines the benefits of having a rupture disc 58 below the piston 64 and a rupture disc 59 above the piston 64, as shown in FIG. 5, by using two sets of rupture discs, one set of rupture discs being disposed below the piston 64, and the other set of rupture discs being disposed above the piston 64, where a set includes at least two rupture discs. The two sets of rupture discs are chosen to have different rupture pressures to provide a two way tool.

In all the embodiments described, the movement of the mandrel has been dependent on the blowing of a rupture disc by overpressurization of the annulus. It should be understood that any other pressure valve could be used in place of rupture discs, for example shear pins. Other possibilities will be apparent to those skilled in the pressure controlled testing art.

It will be apparent from the foregoing description that the embodiments described with reference to FIGS. 3 and 4 overcome the problems of killing ratholes in narrow bore test wells. By selectively communicating the annulus above the set packer with the rathole below the set packer by way of the below packer circulating valve 20 of the present invention, mud can be pumped into the rathole with the packer seals 13 of FIG. 1 in the set position. As a result, killing the rathole becomes a simple and safe operation.

The embodiment of FIG. 4 has the additional advantage that, during normal testing operations, the full width of the flow tube 52 and the inner bore 66 may be used for conveying formation fluids to the surface. The embodiment of FIG. 5 has the advantage that the cushion can be lowered down the string. As a result, liquid cushion fluids rather than gaseous fluids may be used resulting in a considerable saving in cost.

The below packer circulating valve 20 of the present invention, as described, may be used with any existing string systems since the valve is suitable for both tapered and conventional constant diameter strings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. In an apparatus adapted to be disposed in a wellbore including a pipe string, a packer disposed around the pipe string in the wellbore thereby defining an annulus above the packer and a rathole annulus below the packer when said packer is set in said wellbore, a first port disposed through said pipe string and located above said packer in said wellbore, a second port disposed through said pipe string and located below said packer in said wellbore, blocking means disposed within said pipe string for blocking said first port, and pressure responsive means disposed through said pipe string above said packer in said wellbore and responsive to a pressure in said annulus above the packer for allowing said pressure to pass therethrough when said pressure exceeds a predetermined threshold pressure value of said pressure responsive means, a method of removing formation fluids from said rathole annulus when said rathole is filled with said formation fluids, comprising the steps of:

increasing said pressure until said pressure exceeds said predetermined threshold pressure value, said pressure passing through said pressure responsive means when said pressure exceeds the threshold pressure value;

removing the block of said first port by said blocking means in response to said pressure passing through said pressure responsive means, said first port being open when the block is removed; and pumping a fluid from said annulus above the packer and into said first port, through an internal bore of said pipe string, and out of said second port into said rathole annulus when the block of said first port is removed, said formation fluids being removed from said rathole annulus when said fluid is pumped into said rathole annulus.

2. The method of claim 1, wherein said apparatus includes a flow pipe disposed within said pipe string, the method of removing said formation fluids from the rathole annulus comprising the further steps of:

forcing said formation fluids from said rathole annulus into said flow pipe when said fluid is pumped into said rathole annulus in response to the pumping step, said formation fluids flowing to a surface of said wellbore.

3. An apparatus adapted to be disposed in a wellbore, comprising:

a pipe string;

a packer arranged around said pipe string in said wellbore and adapted to be set thereby separating a below packer rathole annulus located below the packer in the wellbore from an above packer annulus located above the packer in the wellbore; and a circulating valve adapted for communicating said rathole annulus with said above packer annulus when said packer is set in said wellbore, said circulating valve including, a housing having an internal bore, a first port disposed through said housing and located above said packer in said wellbore, pressure responsive means responsive to a pressure in said above packer annulus for opening a first communication path between the above packer annulus and the internal bore of said housing and allowing said pressure to pass therethrough when said pressure in said above packer annulus exceeds a predetermined threshold pressure value of said pressure responsive means, a second port disposed through said housing and located below said packer in said wellbore, and first means disposed within said internal bore and initially blocking a second communication path disposed between said first port and said second port for opening said second communication path in response to said pressure passing through said pressure responsive means, said first means including a mandrel having a piston, said pressure being exerted on said piston, said mandrel moving in response to said pressure exerted on said piston, said first means opening said communication path between said first port and said second port when said mandrel moves in response to said pressure on said piston.

4. The apparatus of claim 3, wherein said pressure responsive means comprises a rupture disc associated with said first port.

5. An apparatus adapted to be disposed in a wellbore, comprising:

a pipe string;

a packer arranged around said pipe string in said wellbore and adapted to be set thereby separating a below packer rathole annulus located below the packer in the wellbore from an above packer annulus located above the packer in the wellbore;

a circulating valve adapted for communicating said rathole annulus with said above packer annulus when said packer is set in said wellbore, said circulating valve including, a housing having an internal bore, a first port disposed through said housing and located above said packer in said wellbore, pressure responsive means responsive to a pressure in said above packer annulus for opening a first communication path between the above packer annulus and the internal bores of said housing and allowing said pressure to pass therethrough when said pressure in said above packer annulus exceeds a predetermined threshold pressure value of said pressure responsive means, a second port disposed through said housing and located below said packer in said wellbore, and first means disposed within said internal bore and initially blocking a second communication path disposed between said first port and said second port for opening said second communication path in response to said pressure passing through said pressure responsive means;

a perforating apparatus adapted for perforating an earth formation traversed by said wellbore, well fluid being produced from the perforated formation and collecting in said rathole annulus; and a flow tube disposed within said internal bore of said housing and adapted for receiving said well fluid from said rathole annulus, said well fluid flowing from said rathole annulus into said flow tube and uphole to a surface of said wellbore.

6. The apparatus of claim 5, wherein an outer wall of said flow tube and an inner wall of said housing defines an annular bore space, said flow tube having an internal bore and including a lower end adjacent said rathole annulus and an upper end, a port being disposed through said flow tube at said upper end thereby communicating said annular bore space with said internal bore of said flow tube, said well fluid flowing from said rathole annulus into said lower end of said flow tube and into said annular bore space, the well fluid in said annular bore space flowing into said flow tube via said port at said upper end.

7. The apparatus of claim 6, wherein said first means comprises a mandrel having a piston, said pressure being exerted on said piston, said mandrel moving in response to said pressure exerted on said piston, said first means opening said communication path between said first port and said second port when said mandrel moves in response to said pressure on said piston.

8. The apparatus of claim 7, wherein said pressure responsive means comprises a rupture disc associated with said first port.

9. An apparatus adapted to be disposed in a wellbore, comprising:

a pipe string;

a packer arranged around said pipe string in said wellbore and adapted to be set thereby separating a below packer rathole annulus located below the packer in the wellbore from an above packer annulus located above the packer in the wellbore; and a circulating valve adapted for communicating said rathole annulus with said above packer annulus when said packer is set in said wellbore, said circulating valve including, a housing having an internal bore, a first port disposed through said housing and located above said packer in said wellbore, pressure responsive means responsive to a pressure in said above packer annulus for opening a first communication path between the above packer annulus and the internal bore of said housing and allowing said pressure to pass therethrough when said pressure in said above packer annulus exceeds a predetermined threshold pressure value of said pressure responsive means, a second port disposed through said housing and located below said packer in said wellbore, first means disposed within said internal bore and initially blocking a second communication path disposed between said first port and said second port for opening said second communication path in response to said pressure passing through said pressure responsive means, and further pressure responsive means responsive to a further pressure in said above packer annulus for opening a third communication path between the above packer annulus and the internal bore of said housing and allowing said further pressure to pass therethrough when said further pressure in said above packer annulus exceeds another predetermined threshold pressure value of said further pressure responsive means, said first means closing said second communication path between said first port and said second port in response to said further pressure passing through said further pressure responsive means.

10. The apparatus of claim 9, further comprising:

a perforating apparatus adapted for perforating an earth formation traversed by said wellbore, well fluid being produced from the perforated formation and collecting in said rathole annulus; and a flow tube disposed within said internal bore of said housing and adapted for receiving said well fluid from said rathole annulus, said well fluid flowing from said rathole annulus into said flow tube and uphole to a surface of said wellbore.

11. The apparatus of claim 10, wherein an outer wall of said flow tube and an inner wall of said housing defines an annular bore space, said flow tube having an internal bore and including a lower end adjacent said rathole annulus and an upper end, a port being disposed through said flow tube at said upper end thereby communicating said annular bore space with said internal bore of said flow tube, said well fluid flowing from said rathole annulus into said lower end of said flow tube and into said annular bore space, the well fluid in said annular bore space flowing into said flow tube via said port at said upper end.

12. The apparatus of claim 11, wherein said first means comprises a mandrel having a piston, and wherein:

said pressure is exerted on said piston, said mandrel moving in response to said pressure exerted on said piston, said first means opening said communication path between said first port and said second port when said mandrel moves in response to said pressure on said piston.

13. The apparatus of claim 12, wherein said further pressure is exerted on said piston, said mandrel moving in response to said further pressure exerted on said piston, said first means closing said communication path between said first port and said second port when said mandrel moves in response to said further pressure on said piston.

14. The apparatus of claim 13, wherein said pressure responsive means comprises a rupture disc.

15. The apparatus of claim 14, wherein said further pressure responsive means comprises a rupture disc.

16. In an apparatus adapted to be disposed in a wellbore including a pipe string, a packer disposed around the pipe string in the wellbore thereby defining an annulus above the packer and a rathole annulus below the packer when said packer is set in said wellbore, a first port disposed through said pipe string and located above said packer in said wellbore, a second port disposed through said pipe string and located below said packer in said wellbore, blocking means disposed within said pipe string for blocking said first port, and pressure responsive means disposed through said pipe string and responsive to a pressure in said annulus above the packer for allowing said pressure to pass therethrough when said pressure exceeds a predetermined threshold pressure value of said pressure responsive means, a method of removing formation fluids from said rathole annulus when said rathole is filled with said formation fluids, comprising the steps of:

(a) increasing said pressure until said pressure exceeds said predetermined threshold pressure value, said pressure passing through said pressure responsive means when said pressure exceeds the threshold pressure value;

(b) removing the block of said first port by said blocking means in response to said pressure passing through said pressure responsive means, said first port being open when the block is removed;

(c) pumping a fluid through an internal bore of said pipe string and into said rathole annulus when the block of said first port is removed; and (d) forcing said formation fluids from said rathole annulus into said second port when said fluid is pumped into said rathole annulus, said formation fluids being removed from said rathole annulus when said formation fluids are forced into said second port.

17. The method of claim 16, wherein said apparatus includes a flow pipe disposed within said internal bore of said pipe string, and wherein the pumping step (c) comprises the further step of:

pumping said fluid through said flow pipe and into said rathole annulus when the block of said first port is removed.

18. The method of claim 17, wherein the forcing step (d) comprises the step of:

forcing said formation fluids from said rathole annulus through said second port when said fluid is pumped from said flow pipe into said rathole annulus; and further forcing said formation fluids from said second port, through said first port, and into said annulus above the packer when said fluid from said flow pipe forces said formation fluid from said rathole annulus into said second port.

19. A circulating valve adapted for communicating a rathole annulus with an above packer annulus when a packer is set in a wellbore, comprising:

a housing having an internal bore;

a first port disposed through said housing and located above said packer in said wellbore;

pressure responsive means responsive to a pressure in said above packer annulus for opening a first communication path between the above packer annulus and the internal bore of said housing and allowing said pressure to pass therethrough when said pressure in said above packer annulus exceeds a predetermined threshold pressure value of said pressure responsive means;

a second port disposed through said housing and located below said packer in said wellbore; and first means disposed within said internal bore and initially blocking a second communication path disposed between said first port and said second port for opening said second communication path in response to said pressure passing through said pressure responsive means, said first means including a mandrel having a piston, said pressure being exerted on said piston, said mandrel moving in response to said pressure exerted on said piston, said first means opening said communication path between said first port and said second port when said mandrel moves in response to said pressure on said piston.

20. A circulating valve adapted for communicating a rathole annulus with an above packer annulus when a packer is set in a wellbore, comprising:

a housing having an internal bore;

a first port disposed through said housing and located above said packer in said wellbore;

pressure responsive means responsive to a pressure in said above packer annulus for opening a first communication path between the above packer annulus and the internal bore of said housing and allowing said pressure to pass therethrough when said pressure in said above packer annulus exceeds a predetermined threshold pressure value of said pressure responsive means;

a second port disposed through said housing and located below said packer in said wellbore;

first means disposed within said internal bore and initially blocking a second communication path disposed between said first port and said second port for opening said second communication path in responsive to said pressure passing through said pressure responsive means; and further pressure responsive means responsive to a further pressure in said above packer annulus for opening a third communication path between the above packer annulus and the internal bore of said housing and allowing said further pressure to pass therethrough when said further pressure in said above packer annulus exceeds another predetermined threshold pressure value of said further pressure responsive means, said first means closing said second communication path between said first port and said second port in responsive to said further pressure passing through said further pressure responsive means.

* * * * *